United States Patent [19]

Walsh, III et al.

[11] 4,087,201

[45] May 2, 1978

[54] LOCKING DEVICE FOR A NOZZLE BLOCK AND A METHOD FOR INSTALLING IT

[75] Inventors: John J. Walsh, III, Newtown Square; Mitchell S. Kaminski, Prospect Park, both of Pa.

[73] Assignee: Westinghouse Electric Corp., Pittsburgh, Pa.

[21] Appl. No.: 742,738

[22] Filed: Nov. 17, 1976

[51] Int. Cl.[2] ..... F01D 9/02

[52] U.S. Cl. ..... 415/202; 151/28; 239/600; 292/251

[58] Field of Search ..... 415/202; 239/600; 292/251; 151/33, 28, 44

[56] References Cited

U.S. PATENT DOCUMENTS

| | | | |
|---|---|---|---|
| 1,077,670 | 11/1913 | Church | 151/28 |
| 1,229,693 | 6/1917 | Wilson | 151/33 |
| 1,232,024 | 7/1917 | Garland et al. | 151/44 |
| 1,809,666 | 6/1931 | Bauer et al. | 415/202 |
| 2,286,950 | 6/1942 | Breedlove | 151/33 |
| 2,419,849 | 4/1947 | Morris | 151/44 |

FOREIGN PATENT DOCUMENTS

| | | | |
|---|---|---|---|
| 566,280 | 11/1958 | Canada | 415/202 |

*Primary Examiner*—C. J. Husar
*Attorney, Agent, or Firm*—J. W. Keen

[57] ABSTRACT

An apparatus used in steam turbines for locking a nozzle block and nozzle chamber together. At least one modified cap screw is engaged with the nozzle block and nozzle chamber and tightened to a required torque. A plate is affixed to either two or more modified cap screws or to both a modified cap screw and the surrounding base metal of the nozzle block or nozzle chamber with one rivet passing through the plate into the modified cap screw and a second rivet passing through the plate into the nozzle block, nozzle chamber, or other modified cap screw. The rivets and attaching plate restrain relative motion between the cap screw and the surrounding base metal of the nozzle block or nozzle chamber thus preventing the modified cap screw from loosening.

16 Claims, 17 Drawing Figures

FIG.5
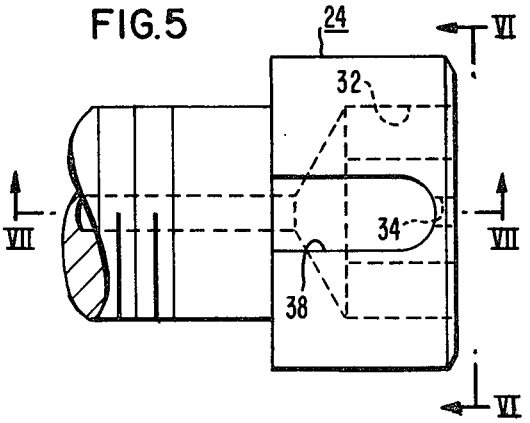
FIG.6
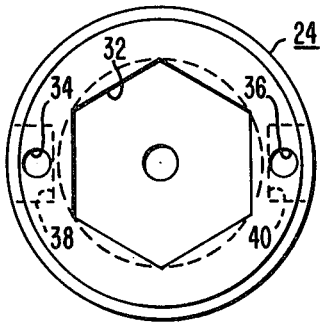
FIG.7
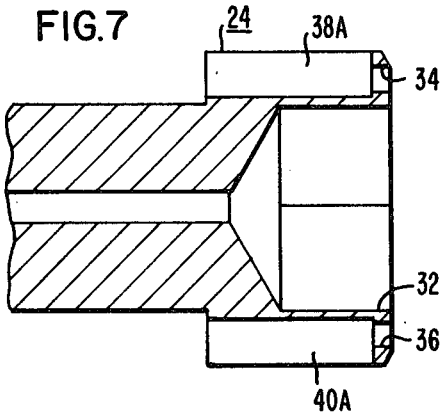
FIG.8
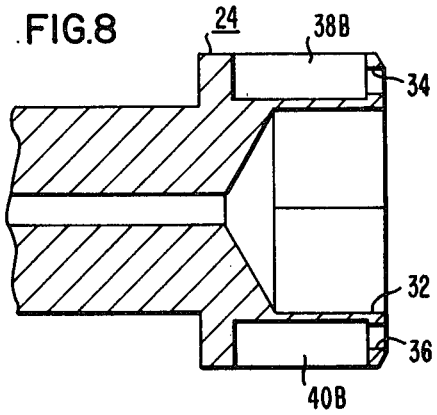
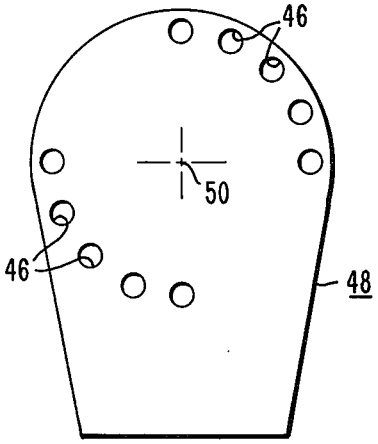
FIG.9
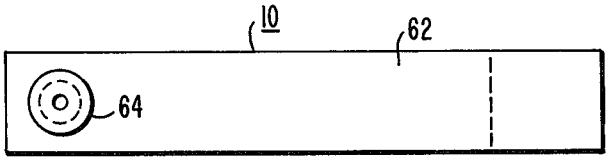
FIG.11
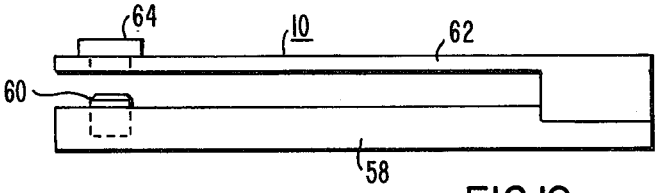
FIG.10

LOCKING DEVICE FOR A NOZZLE BLOCK AND A METHOD FOR INSTALLING IT

BACKGROUND OF THE INVENTION

1. Field of the Invention

This invention relates to securing threaded fasteners in engagement within a steam turbine and more particularly to means for locking a nozzle block to a nozzle chamber.

2. Description of the Prior Art

It is good turbine engineering practice to use a locking device of some sort on all fasteners, such as screws and bolts that are within the turbine. Turbine unbalance vibration and steam flow excitation can loosen fasteners if locking devices for the fasteners are not utilized. The most commonly used steam turbine locking devices are pins and pant leg washers. Other locking devices that can be used for fasteners are threaded friction plugs, lock wires, cotter pins, and tack welding. In some areas which are not conducive to using the normal locking devices, turbine protection is sometimes obtained by trapping the fastener.

Turbine nozzle block cap screws are especially prone to loosening and, in some cases, come completely free causing damage to other tubine parts. In the past, the following have been used as locking or containment devices: retaining rings, end plugs, and caulking strips. None of these devices were completely successful in locking the nozzle block cap screws. The most recent locking method used was pinning each nozzle block cap screw. This provided a positive locking device but caused some problems in the assembly and removal of the pins.

During assembly, the nozzle block cap screws are inserted through the nozzle block and into threaded engagement with the nozzle chambers, or alternately from the opposite side, through the nozzle chamber and into threaded engagement with the nozzle block. The nozzle block and nozzle chamber have predrilled holes provided for the nozzle block cap screw pins. The pin holes in the cap screw heads cannot be drilled until the cap screws have been torqued. At that time, a pin hole must be hand drilled through the cap screw head in alignment with the predrilled hole in the nozzle block or nozzle chamber. The hand drilling is a difficult field operation because of the hardened cap screw material. Hand reaming of the drilled holes is also necessary to obtain the required pin fit because if the fit is too loose, no locking action is obtained and if the fit is too tight, the pin may hang up during assembly. After assembly, the pin projects through the nozzle block or nozzle chamber pin hole, through the hand drilled hole in the cap screw head, and into the exposed internal hex indentation in the cap screw head.

For cap screw removal, the pin length projecting into the internal hex of the cap screw head must be sheared off before a wrench can be inserted into the internal hex indentation. The remaining pin length extending from the nozzle block or nozzle chamber into the cap screw is sheared off by removing the cap screw from the nozzle block or nozzle chamber with the wrench. When cap screw removal has been accomplished, the pin length remaining in the nozzle block or nozzle chamber must be either driven into the cap screw's hole in the nozzle block and sheared off or drifted out the opposite direction. This procedure of driving and shearing must be repeated until the entire length of the pin has been removed from the nozzle block or nozzle chamber. Occasionally, the pin becomes lodged in the pin hole and can only be removed by drilling. This procedure is time-consuming if required, and a pin of larger diameter is then necessary for reassembly.

During reassembly of the previously-used and drilled nozzle block cap screw, it is highly unlikely that the predrilled pin holes in the nozzle block or nozzle chamber and in the cap screws will be in alignment after the nozzle block cap screws have been tightened to the required torque. Possible solutions for obtaining alignment are: increasing the depth of counterbore for the cap screw head, removing material from the cap screw head's seating face, or drilling a new hole in the cap screw head. These solutions are undesirable from reliability or time consumption considerations.

SUMMARY OF THE INVENTION

This invention is a locking apparatus used to secure a nozzle block to the nozzle chamber of a steam turbine. The invention generally comprises a plate connected to two or more threaded fasteners or to both a nozzle block or nozzle chamber and a threaded fastener which is in engagement with the nozzle block and nozzle chamber. Connecting the plate to the nozzle block and threaded fastener or to two or more threaded fasteners is accomplished after the threaded fastener or fasteners have been tightened to the required torque by disposing a fastener through the plate into the threaded fastener and passing a second fastener through the plate into the nozzle block, nozzle chamber, or the second threaded fastener.

This method is an improved procedure for locking the nozzle block to the nozzle chamber in a steam turbine. This method generally comprises extending a threaded fastener through a nozzle block and into engagement with the nozzle chamber or, alternately from the opposite side, through the nozzle chamber and into threaded engagement with the nozzle block of a steam turbine. After the threaded fastener has been torqued to a predetermined value, one end of a plate is affixed to the head of the threaded fastener and the second end of the plate is affixed either to the nozzle block, nozzle chamber, or other pretorqued threaded fastener. After a first fastener is inserted through a previously formed first port in the plate and into the head of the threaded fastener, the plate and nozzle block or nozzle chamber are attached by inserting another fastener through a second port in the plate and a preformed opening in the nozzle block or nozzle chamber. The plate's second port is made by using a U-shaped tool which locates the preformed opening concealed beneath the plate and guides the formation of the plate's second port so that it will be in alignment with the preformed opening. If two or more threaded fasteners are to be fixed to the plate, a modified U-shaped tool is used to locate previously formed holes in the head of the threaded fasteners which are hidden beneath the plate and to guide the formation of the plate ports so they will be in alignment with the threaded fastener's head holes. Fasteners are then inserted through the plate ports and into the heads of the threaded fasteners.

This invention provides a positive locking of the nozzle block to the nozzle chamber, yet simplifies and decreases the time necessary for assembly, removal and reassembly of the nozzle block to the nozzle chamber.

BRIEF DESCRIPTION OF THE DRAWINGS

For a better understanding of the invention, reference may be had to the preferred embodiment exemplary of the invention shown in the accompanying drawings in which:

FIG. 5 is an elevation view of a modified nozzle block cap screw;

FIG. 6 is an elevation view of the modified nozzle block cap screw taken 90° from FIG. 5;

FIG. 7 is a sectioned view of the modified nozzle block cap screw taken along the section line indicated in FIG. 5;

FIG. 8 is a sectioned view of the modified nozzle block cap screw showing an alternate machining method from that indicated in FIG. 7;

FIG. 9 is an elevation view of the plate which is secured to both the nozzle block cap screw and the nozzle block or nozzle chamber;

FIG. 10 is an elevation view of a U-shaped tool used in locating a preformed opening in the nozzle block or nozzle chamber and guiding the drilling of the plate port to be in alignment with the preformed opening;

FIG. 11 is a plan view of the U-shaped tool;

DESCRIPTION OF THE PREFERRED EMBODIMENT

Figure 1:
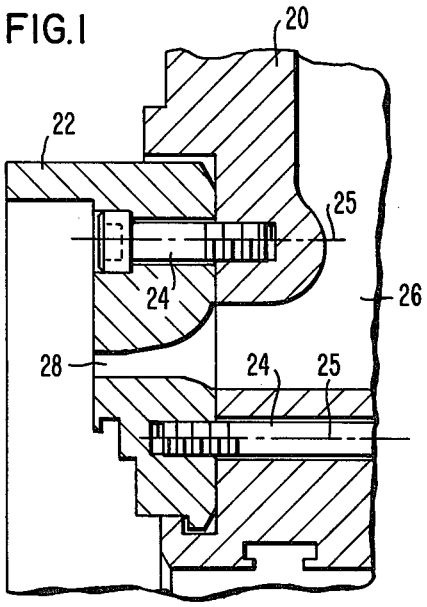
FIG. 1 is a partial sectioned view of a nozzle block secured to a nozzle chamber.

Referring now to the drawings in detail, FIG. 1 shows a partial sectioned view of nozzle chamber 20 secured to nozzle block 22 by a socket head cap screw 24 having center line 25. Steam enters cavity 26 in nozzle chamber 20 and flows through nozzle 28 which directs the steam against an annular array of circumferentially spaced rotatable blades (not shown) forming the first stage of the steam turbine.

Figure 2:
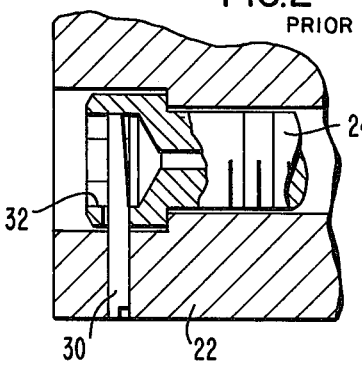
FIG.2 PRIOR ART
FIG. 2 is a sectioned view of the pin method for locking nozzle block cap screws in position.

FIG. 2 illustrates the most prior art method of locking the socket head cap screw 24 into the nozzle block 22. A pin 30 is inserted through both nozzle block 22 and the head of socket head cap screw 24 extending into the internal hex indentation 32.

Figure 3:
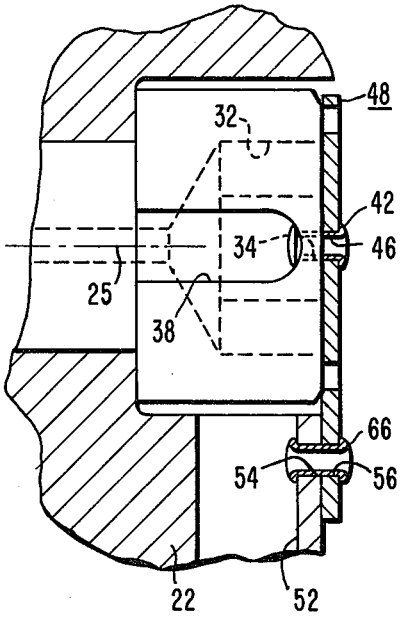
FIG. 3 is a partial sectioned view of this invention's method for locking the nozzle block cap screws in position.
Figure 4:
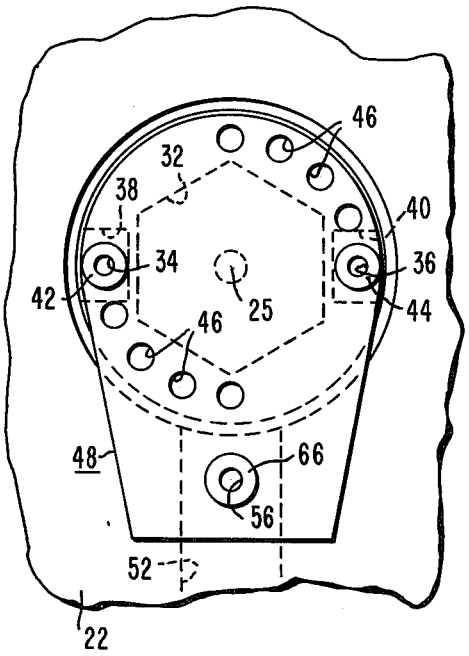
FIG. 4 is an elevation view of this invention taken 90° from FIG. 3.

FIGS. 3 and 4 demonstrate this invention's use and how cap screw 24 is locked in engagement with nozzle block 22. Cap screw 24, better displayed in FIGS. 5, 6, 7 and 8, has two holes 34 and 36 located 180° apart on the cap screw head starting from the head end of the cap screw and terminating approximately ¼ inch into the head. Two larger openings 38 and 40 are disposed at the terminating points of holes 34 and 36 and connect with holes 34 and 36. FIGS. 7 and 8 show alternate types of larger openings 38A and 40A contrasted with 38B and 40B. Hole 34 acting in concert with opening 38 and hole 36 acting in concert with opening 40 each receive a rivet or other fastener 42 and 44.

The rivets 42 and 44 protrude from the cap screw head through predrilled ports 46 in plate 48 which is better illustrated in FIG. 9. The first set of five ports 46 are equally spaced circumferentially within 90° of arc, by example, and radially located the same distance from the plate center 50 as holes 34 and 36 are from the cap screws' center line 25. A second set of five ports 46 are radially located from the plate center 50 a distance equal to the radial distance to the first set of five ports with each port in the second set positioned 180° from a port in the first set. The ports holes 46 allowing rivets 42 and 44 to pass are selected from the ten available ports by positioning the undrilled end of plate 48 over predrilled openings 52 and 54 of the nozzle block 22. Port 56 is made in alignment with hole 54 by use of a U-shaped hole finder tool illustrated in FIGS. 10 and 11.

The hole finder tool has a semi-cylindrical plate 58 supporting a hollow rod 60 on one end and is connected to plate 62 on the other end. Plate 62 supports a drill guide 64 whose center line is in alignment with rod 60's center line. Port 56 is drilled in plate 48 by use of the drill guide 64 after plate 58 of the hole finder tool has been inserted into opening 52 of the nozzle block and rod 60 has been extended through opening 54.

Port 56 is then in alignment with opening 54 allowing a rivet or other fastener 66 to be placed therein completing the assembly of this invention and thereafter preventing any relative motion between cap screw 24 and nozzle block 22.

It is to be understood that the nozzle block 22 is frequently secured to the nozzle chamber 20 by cap screws inserted from the nozzle chamber side rather than from the nozzle block side. In such case, openings 52 and 54 are made in the nozzle chamber 20 with the result that plate 48 is secured to the nozzle chamber 20 after cap screw 24 has been inserted through nozzle chamber 20 and into threaded engagement with nozzle block 22 leaving the cap screw's head exposed on the nozzle chamber side.

Figure 12:
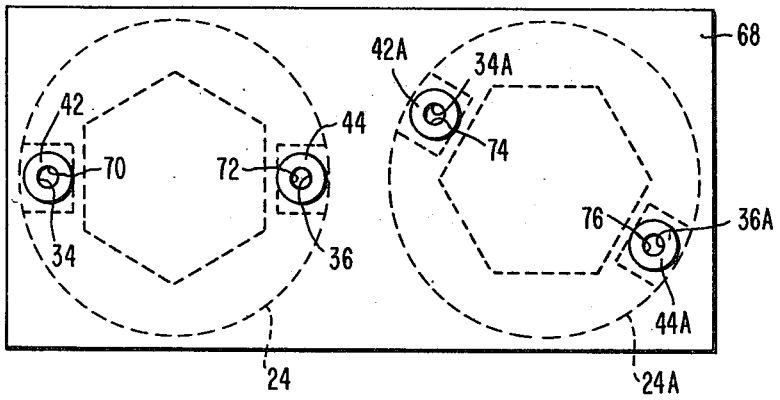
FIG. 12 is a plan view of a plate securing two modified nozzle block cap screws.
Figure 14:
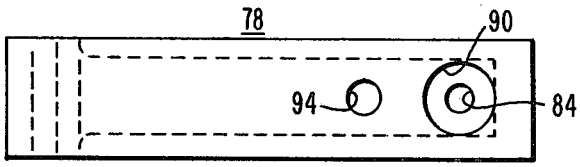
FIG. 14 is a plan view of the modified U-shaped tool.
Figure 15:
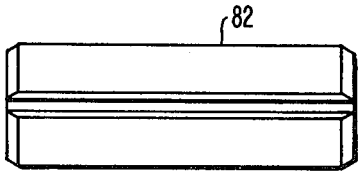
FIG. 15 is an elevation view of a spring pin used in the modified U-shaped tool.
Figure 13:
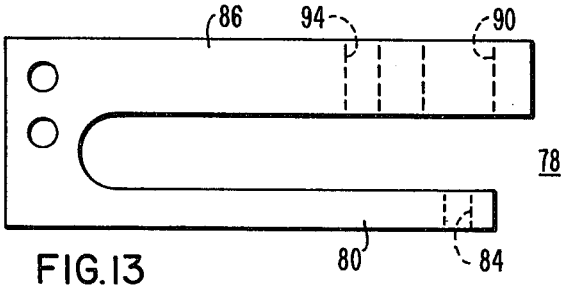
FIG. 13 is an elevation view of a modified U-shaped tool used in locating the previously formed openings in the modified cap screws, holding a blank plate securely, and guiding the drilling of plate ports to be in alignment with the modified cap screw openings.
Figure 16:
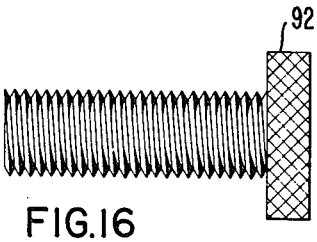
FIG. 16 is an elevation view of a threaded locking fastener for use with the modified U-shaped tool.
Figure 17:
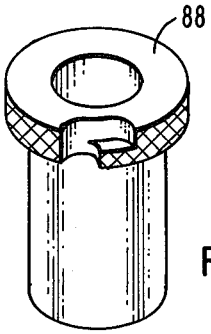
FIG. 17 is an isometric view of a bushing.

FIG. 12 shows an alternate method for preventing loosening of socket head cap screws 24 and 24A. Blank plate 68 is fixed to two socket head cap screws 24 and 24A by placing rivets 42, 44, 42A, and 44A through ports 70, 72, 74, and 76 formed in plate 68 and into each predrilled socket head cap screw hole 34, 36, 34A, and 36A. Ports 70, 72, 74 and 76 are formed in plate 68 in alignment with holes 34, 36, 34A, and 36A by utilizing a modified U-shaped tool 78 illustrated in FIGS. 13 and 14. Leg 80 of tool 78 is positioned above the head of a pre-torqued socket head cap screw 24 so that a spring pin 82, illustrated in FIG. 15, can be inserted through hole 84 into socket head cap screw hole 34. One end of plate 68 is disposed between legs 80 and 86 and the other end of plate 68 is positioned above the head of socket head cap screw 24A. Drill bushing 88 is inserted in hole 90 and threaded locking fastener or drill bushing lock screw 92 shown in FIG. 16 is turned through threaded hole 94 securing both plate 68 and drill bushing 88 in the proper position to form port 70 in plate 68 by using drill bushing 88 as a guide for port formation. Lock screw 92 is then loosened, spring pin 82 is removed from hole 84 and reinserted through holes 34 and 70 to retain hole alignment after tool 78 has been moved, and the procedure is repeated to make ports 72, 74, and 76.

By way of example cap screws 24 and 24A are 1.25 inches nominal size and approximately 5.5 inches long. A typical size for holes 34, 34A, 36, and 36A, and for ports 70, 72, 74, 76 and 46 is 0.19 inches in diameter with the accompanying openings 54 and 56 being 0.28 inches in diameter. Openings 38 and 40 are characteristically 0.625 inches in width and 0.31 inches in depth. Holes 34, 34A, 36, and 36A are drilled 0.75 inches from the center 25 of the exemplified cap screw 24. Plate 48 is 0.09 inches thick with one circular end of diameter 1.875 inches and one flat end which is located approximately 1.875 inches from the plate centerline 50 and is 1.25 inches in width. Plate 68 is 0.09 inches thick, 2.0 inches in width, and of variable length to accommodate as many cap screws as desired. Plates 48 and 68 may be of thinner stock, but can be stacked to obtain a 0.09 inch thickness thus allowing the plates to be easily bent to accommodate possible out-of-plane alignment between the cap screw ends or between the cap screw end and nozzle block or nozzle chamber surface. Rivets 42, 42A, 44, and 44A are 0.188 inches nominal size with rivet 66 being 0.25 inches nominal size. The rivet is typically A-286 material and the plate may be either Inconel Alloy 600 or stainless steel, AISI 410.

We claim:

1. A steam turbine having a nozzle chamber in fluid communication with a rotor through a nozzle block, said nozzle block being secured to said nozzle chamber by a locking apparatus, said locking apparatus comprising:

a threaded fastener having a head end with a first opening extending into said head from said head end;

a base having a first hole with said threaded fastener disposed therein and an aperture;

a plate extending over said head end onto said base with said plate having a first port and a second port, said first port being in general alignment with said first opening and said second port being in general alignment with said aperture; and a first fastener disposed in the generally-aligned first port and first opening and a second fastener disposed in the generally-aligned aperture and second port whereby relative motion between said threaded fastener and said base is prevented by affixing said threaded fastener to said base with said plate and fasteners.

2. The apparatus of claim 1, said threaded fastener comprising a socket head cap screw with said head end opening disposed on the periphery of said head end outside said socket head indentation.

3. The apparatus of claim 2, said socket head cap screw's first opening comprising:

a second hole from said head end extending less than the thickness of said head; and a second opening adjacent to, abutting on, connected to, and in general alignment with said second hole wherein said second opening is farther from said head end than said second hole and with said second opening extending outside the diameter of said second hole at all points.

4. The apparatus of claim 3, said second opening comprising a third hole in said head from the threaded end of said socket head cap screw extending toward said second hole and being connected with said second hole wherein said third hole's diameter surrounds said second hole's diameter.

5. The apparatus of claim 1, said plate comprising material having a thermal expansion coefficient similar to that of said threaded fastener.

6. The apparatus of claim 1, said first and second fasteners comprising two rivets.

7. The apparatus of claim 1, said aperture comprising:

a third opening extending into said base with said third opening having a first end at a surface of the base and a second end within said base; and a fourth opening adjacent to, abutting on, and connected to said second end of said third opening wherein said fourth opening is larger than said third opening at the connecting interface between said third and fourth openings.

8. The apparatus of claim 1, said base comprising: a nozzle block.

9. The apparatus of claim 1, said base comprising: a nozzle chamber.

10. A steam turbine having a nozzle chamber in fluid communication with a rotor through a nozzle block, said nozzle block being secured to said nozzle chamber by a locking apparatus, said locking apparatus comprising:

a plurality of threaded fasteners engaged in a base with each threaded fastener having a head end with at least one opening extending into each head from said head end;

a plate extending over said head ends with said plate having a plurality of ports which are in general alignment with said openings; and a plurality of fasteners disposed in the generally-aligned ports and openings whereby relative motion between said plurality of threaded fasteners and said base is prevented by affixing said threaded fasteners to said plate with said fasteners.

11. The apparatus of claim 10, wherein the distance between centerlines of any selected pair of said head ends is different than the distance between centerlines of any selected pair of said openings where the selected pair of said openings are on different head ends of the selected pair.

12. The apparatus of claim 11, said threaded fasteners comprising socket head cap screws with said head end opening disposed on the periphery of said head end outside said socket head indentations.

13. The apparatus of claim 12, said socket head cap screws' first opening comprising:

a second hole from said head ends extending less than the thickness of said heads; and a second opening adjacent to, abutting on, connected to, and in general alignment with said second hole wherein said second opening is farther from said head end than said second hole at the interface between said second hole and second opening and with said second opening extending outside the diameter of said second hole at all points.

14. The apparatus of claim 13, said second opening comprising a third hole in said head from the threaded end of said socket head cap screw extending toward said second hole and being connected with said second hole wherein said third hole's diameter surrounds said second hole's diameter.

15. The apparatus of claim 10, said base comprising: a nozzle block.

16. The apparatus of claim 10, said base comprising: a nozzle chamber.

* * * * *